US005272609A

United States Patent [19]

Nelson

[11] Patent Number: 5,272,609

[45] Date of Patent: Dec. 21, 1993

[54] PORTABLE LIGHTING UNIT

[75] Inventor: Robert C. Nelson, Daniels, W. Va.

[73] Assignee: Century Mfg. and Eqpt., Inc., Beckley, W. Va.

[21] Appl. No.: 934,193

[22] Filed: Aug. 21, 1992

[51] Int. Cl.[5] ..... F21V 21/14

[52] U.S. Cl. ..... 362/250; 362/419; 362/427

[58] Field of Search ..... 362/61, 238, 250, 285, 362/382, 403, 418, 419, 431, 450, 27

[56] References Cited

U.S. PATENT DOCUMENTS

| | | | |
|---|---|---|---|
| 1,419,949 | 6/1922 | Sharp et al. | 362/419 |
| 1,636,606 | 6/1927 | King | 361/250 |
| 2,580,699 | 1/1952 | Pfetzing | 362/61 |
| 3,495,364 | 2/1970 | De Bella | 362/385 |
| 4,181,929 | 1/1980 | Barber et al. | 362/192 |
| 4,220,981 | 9/1980 | Koether | 362/61 |
| 4,300,186 | 11/1981 | Hurd | 362/66 |
| 4,363,084 | 12/1982 | Dimiceli | 362/250 |
| 4,428,037 | 1/1984 | Cardoza et al. | 362/250 |
| 4,450,507 | 5/1984 | Gordin | 362/61 |
| 4,600,980 | 7/1986 | Dahlgren | 362/385 |
| 4,796,172 | 1/1989 | Chestnut | 362/427 |
| 4,827,389 | 5/1989 | Crum | 362/388 |
| 4,841,416 | 6/1989 | Doss | 362/183 |
| 4,928,216 | 5/1990 | Carr | 362/250 |
| 4,935,854 | 6/1990 | Kernodle | 362/250 |
| 5,012,894 | 4/1991 | Woodward | 362/419 |

*Primary Examiner*—Albert J. Makay
*Assistant Examiner*—Alan B. Cariaso
*Attorney, Agent, or Firm*—McCaleb, Lucas & Brugman

[57] ABSTRACT

A portable lighting unit comprising a three wheeled transportation vehicle having a low slung bed frame mounted over two axially aligned wheels while a third wheel thereof is pivotally mounted at one end of the vehicle frame and is steerable in response to movements of a pulling tongue. Plural high intensity flood lamps are mounted in parallel horizontal banks atop two elongated light bars which in turn are pivotally carried on top of vertically adjustable telescopic masts for pivoting the lamps. Additionally portable flood lights are detachably mounted on the light bars for hand held mobile spot light operation or selective positioning remotely of the vehicle on ground engaging stands. A heavy duty battery powers the lamps and flood lights over switch controlled circuits available via insulated cables and a distribution panel.

11 Claims, 8 Drawing Sheets

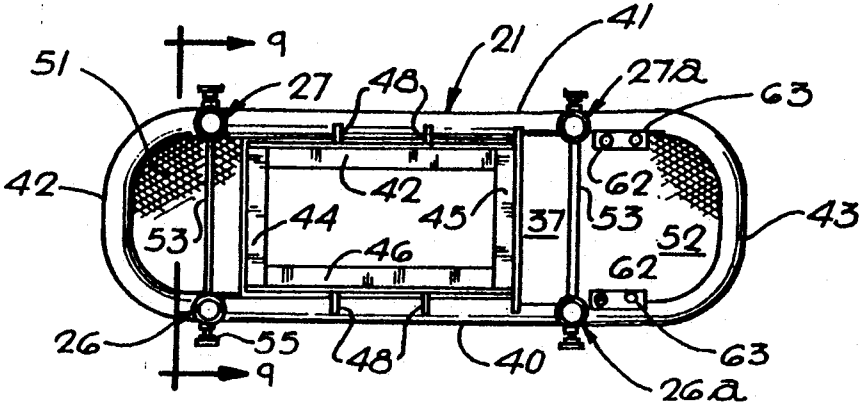
FIG. 8
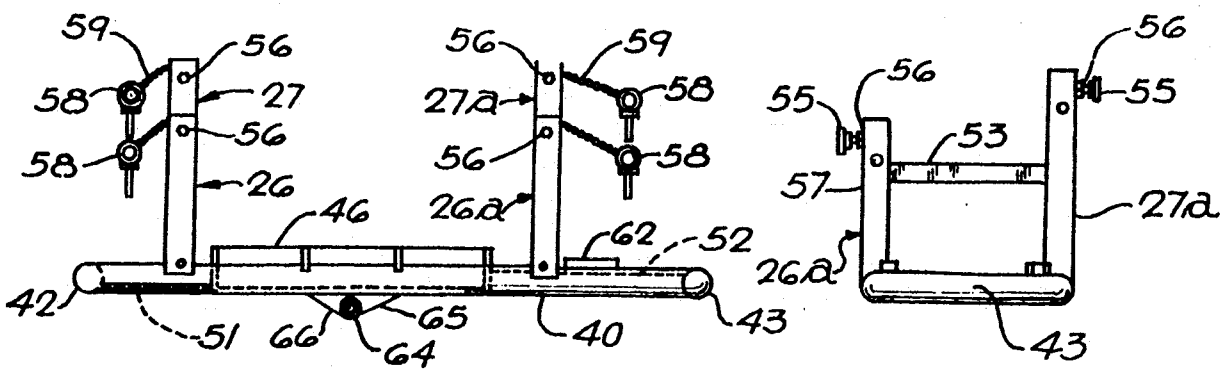
FIG. 7
FIG. 5
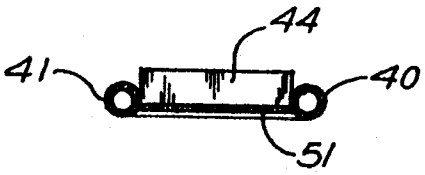
FIG. 9
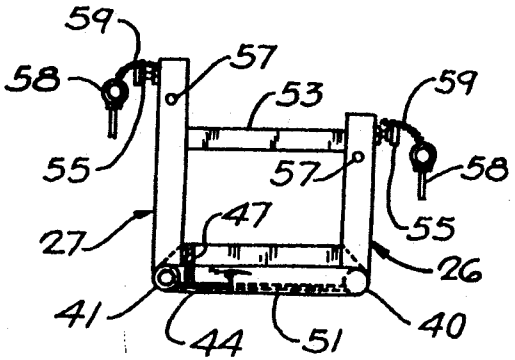
FIG. 6

PORTABLE LIGHTING UNIT

BACKGROUND OF THE INVENTION

There are numerous instances requiring a relatively compact, lightweight, quiet mobile lighting unit capable of providing high intensity illumination in the order of 1-3 million candle powers, for an extended period and which is operable independently of stationary or even portable power generators.

Typifying such instances are various night time activities, such as building or road construction, security checks of warehouses as well as field repair of equipment and a variety of operations common to mining activities where cumbersome generators and lights are usually hauled to the operating sight in question.

In still other instances, drug enforcement officials have urgent need for silent, portable lights in border patrol operations to assist in apprehending smugglers and illegal entrants. A similar need exits for emergency service personnel, such as paramedics and firemen, who frequently are required to perform in remote or difficult to reach areas where artificial lighting is either unavailable or inadequate.

While there are numerous known prior art developments for mobile lighting equipment, such are normally energized by noisy gasoline or diesel powered generators, frequently in conjunction with long heavy power cables extending between the generator and lights. In many such previously developed units, tall elevatable masts are employed to mount one or more flood lights which, however, makes directional adjustment of the elevated lights difficult and cumbersome.

In certain other instances battery powered flood lights have been resorted to, but these have been of limited lighting capacity and operational duration.

Still other developments have been directed to portable light masts adapted to be detachably mounted on motor vehicles, such as fire or light pick-up truck and which frequently are powered by heavy and noisy motor generators carried by the vehicle.

Despite such prior developments, there still exists a real and urgent need and demand for a relatively simple, mobile emergency lighting unit which is self-powered and can be carried by or towed behind a motor vehicle and yet is lightweight enough to be manually pulled and maneuvered by one or two men over practically any terrain while at the same time providing a quiet, high intensity and powerful light source that may be quickly and efficiently directed, as desired.

BRIEF SUMMARY OF THE INVENTION

This invention is directed to an improved mobile, relatively quiet or passive emergency lighting apparatus which meets and satisfies the aforementioned needs and obviates the shortcomings of the prior art.

In brief this invention comprises a lightweight vehicle frame supported by multiple ground engaging wheels, and which is steerable, remote control or by manipulation of a pulling tongue, for example. A heavy duty battery is supported on the frame in balanced alignment with two axially aligned wheels on opposite sides of the frame whereby to promote balance and ease of handling the vehicle. A circuit panel is electrically coupled to the battery and provides selective switch controlled connection with power cables leading to twin banks of high intensity lamps adjustably mounted atop parallel spaced light bars which in turn are joined to the upper ends of four vertically adjustable, telescopic masts fixed to the vehicle frame. At least one and preferably more portable flood lights, also powered over the control panel, are carried by mountings at opposite ends of the light bars. Such flood lights are removeable from their mountings to perform as hand held spotlights or alternatively are mountable in portable support stands located remotely of the vehicle. The several flood lights are individually tiltable and rotatable in their mounts. Similarly the light bars are tiltable about their connections with the masts. Manually operated switches are provided to selectrically control energization of the lamps and lights as desired. All the lamps and lights are readily accessible to the user throughout the range of their adjustment positions.

It is a primary object of this invention to provide an improved and simplified portable, generally noise free lighting unit carried by a lightweight vehicle.

Still another object of this invention is to provide a lighting unit as aforesaid which is adapted to be trailed by a motor vehicle and/or manually maneuvered to a selected area of use.

Still another object of this invention is to provide an improved and simplified lightweight, portable lighting unit carried by a wheel mounted vehicle which supports a plurality of high intensity incandescent lights, some of which are removeable from the vehicle and capable of operating as mobile spotlights.

A further and important object of this invention is to provide an improved and simplified portable lighting unit capable of providing a source of high intensity light in the order of two to three million candle powers which may be adjusted and directed to desired areas of illumination.

An additional important object of this invention is to provide an improved, simplified, portable lighting unit carried by a lightweight wheel mounted vehicle capable of being manually moved and manipulated and which comprises a plurality of high intensity lamps illuminated by a battery source carried by the vehicle.

Having thus described this invention, the above and further objects, features and advantages thereof will be recognized from the following detailed description of a preferred embodiment thereof, illustrated in the accompanying drawings, and representing the best mode presently contemplated for enabling those of skill in the art to practice this invention.

IN THE DRAWINGS

FIG. 5 is a side elevational view of a supporting main frame embodied in the lighting unit of FIGS. 1-4;

FIG. 6 is a left hand end elevation thereof with portions broken away in section;

FIG. 7 is a right hand elevation thereof;

FIG. 8 is a top plan view thereof;

FIG. 9 is a cross sectional view taken substantially along vantages line 9—9 of FIG. 8, looking in the direction of the arrows thereon;

DESCRIPTION OF THE PREFERRED EMBODIMENT

Figure 1:
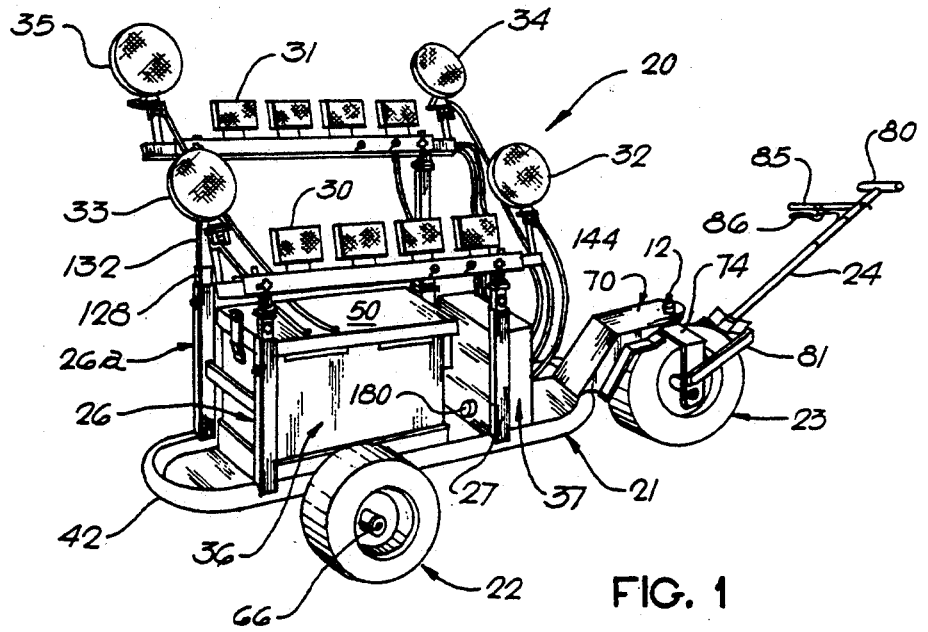
FIG. 1 is a perspective showing of a portable lighting unit embodying the features of this invention.

With reference now to FIGS. 1–4 of the drawings it will be recognized that a lighting unit, indicated generally at 20 is therein illustrated as comprising a portable vehicle, in this case man powered, having a lightweight low slung main frame 21 of general rectangular plan configuration under supported by a pair of ground engaging, pneumatically tired rear wheels 22, 22. In this embodiment a third front wheel 23 is aligned along the longitudinal axis of the frame and generally forward of the front end thereof; wheel 23 being supported for movement about a generally vertical axis in addition to its rolling movement about a horizontal axle. A suitable tow bar 24 is coupled to the support for wheel 23 for the purpose of transmitting pulling forces to the frame and effecting turning movements of the wheel 23 to steer the vehicle in operation. It is also fully contemplated that two front wheels mounted on a steerable front axle maybe used, if desired.

Four telescopic, multi-sectioned masts or posts 26, 26*a* and 27, 27*a* extend vertically upwardly from frame 21 in mutually parallel spaced relationship. The masts 26 and 27 are disposed along one longitudinal side of the frame in spaced parallelism to support a horizontal light bar 28 while preferably longer masts 26*a* and 27*a* are disposed on the opposite side of the vehicle to support a second horizontal light bar 29. Thus the two light bars be located in vertically offset parallelism as shown. Light bar 28 carries a plurality of flood lamps 30 while the second light bar 29 carries a corresponding number of flood lamps 31; such lamps 30 and 31 projecting upwardly from the upper side of their respective bars 28 and 29. In addition, each of the light bars carries one or two flood lights such as the illustrated twin lights 32 and 33 on bar 28 and 34, 35 on bar 29; such flood lights being detachably mounted for removeable portability independently of the light bars.

Located beneath the light bars, lamps and lights and generally between the rear wheels 22 of the vehicle frame 21 is a battery compartment 36 containing one or more high powered, preferably wet cell batteries for powering the lights and lamps via a control console 37 located forwardly of the battery compartment 36 and having suitable circuit connectors and control switches for selectively powering the portable lights and lamps on each of the light bars over appropriate cable conductors coupled to the control console by means of suitable socket connectors or the like, as will be described more fully hereinafter.

With reference to FIGS. 5–9 of the drawings, features of main frame 21 will be recognized. As noted in FIGS. 5 and 8 in particular, frame 21 comprises a pair of generally elongated, parallel, tubular side rails 40 and 41 which are laterally spaced sufficiently to accommodate the battery compartment 36 therebetween. Members 40, 41 desirably are made of 2½" OD round mechanical metal tubing with a wall thickness substantially ⅛" and are integral with curvilinear end pieces 42 and 43 by appropriately welding the end pieces to the adjacent ends of the members 40 and 41 to form an integrated fabricated tubular structure.

Extending between the side rails 41 and 40 are two angle plates 44 and 45; the ends of which are contoured to the round tubular bars 40 and 41 and welded thereto. The two plates 40, 45 are in parallel spaced relation and are interjoined by additional angle bars 46 and 47 which extend along the inner sides of the tubular members 40, 41, respectively. The angle bars 46, 47 are welded to the bars 44 and 45 and are fixed to the side rails 40, 41 by wedge pieces 48 which in turn are welded to the rails 40, 41. This configuration of the bars 44–47 constitutes a rectangular base frame receptive of the battery compartment 36 (see FIGS. 1 and 2) which for all intents and purposes constitutes a lightweight rectangular metal box having a removeable cover 50 for containing one or more multiple plate wet cell batteries to serve as the power source for illuminating the lights and lamps of unit 20.

Beneath the rectangular battery frame formed by members 44–46 and extending to the curvilinear end portion 42 of the main frame is an expanded metal floor 51. A solid metal plate 52 also extends from the member 45 to the curvilinear end portion 43, adjacent the upper regions of the frame member 41 and 42. It will be understood, of course, that the expanded metal floor also is affixed to the frame members, as by welding.

Projecting upwardly from the frame member 40 and adjacent opposite ends thereof, are two parallel disposed telescopic mast 26, 26*a* preferably made of round or square tubular material having an outside diameter of 2½", conforming with the frame members 40–43.

In a similar manner, two telescopic masts 27 and 27*a* are fixed at their bottom ends to their associated side frame member 41 so that the several masts are in mutual parallelism. As noted in particular from FIGS. 5 and 8 masts 26 and 27 are coplanar as are masts 26*a* and 27*a*. Light metal rectangular tubular cross bar members 53, 53 extend between the masts members 26, 26*a*, and 27, 27*a*, respectively, to provide lateral support and rigidity to the mast structures. Each of the masts is receptive of one or more smaller diameter extension sections, as will appear later, whereby the masts may be extended vertically to selected elevations.

It further will be noted that the mast pair 26*a* and 27*a* are somewhat longer than the masts 26, 27, although all masts may be equal length, if desired.

In the particular embodiment illustrated in FIGS. 5–7 each of the masts 26–27*a* has a thumb wheel locking bolt 55 threadingly engageable with a cooperating nut 56 located near the upper end thereof for locking an inner telescopic section (not shown in these figures) in a desired vertical adjusted position. In this respect, the nut 56 associated with each thumb operated adjustment bolt is welded to the exterior of its respective mast tube over a opening through the side walls thereof so that the inner end of the adjustment bolt 55 may engage a radially inwardly disposed tubular extension section.

In addition, each of the masts 26–27*a* has at least one opening 57 for reception of a locking pin 58 connected to the mast by a chain or like articulatable fasting means 59 (see FIG. 5). Such pins and openings may be utilized for quick telescopic adjustment of the inner mast sections to raise each mast to a prescribed predetermined elevation depending on the location of the locking pins and holes with the thumb bolts serving to provide refinement of the adjusted position as required.

Figure 4:
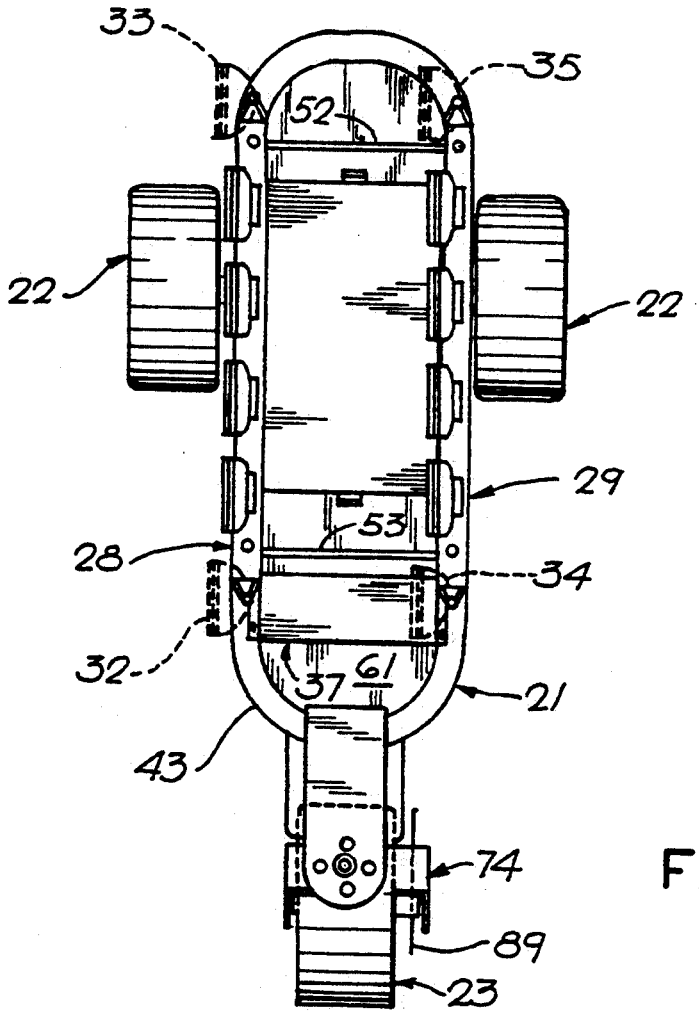
FIG. 4 is a top plan view thereof.

Extending forwardly of the battery carrier made up of the frame members 44–47 as previously described, is the aforementioned metal floor plate 52 welded to the side rails 40, 41 and end frame member 43. Mounted atop floor member 52 and adjacent the junction of the side rails 40, 41 with the end rail 43, are a pair of mounting blocks 62, 62 that are welded to the floor plate. These blocks are provided with two threaded openings 63 receptive of cap screws or the like for fastening the control console 37 in position just forwardly of cross bar 53, as shown in FIG. 4.

Figure 3:
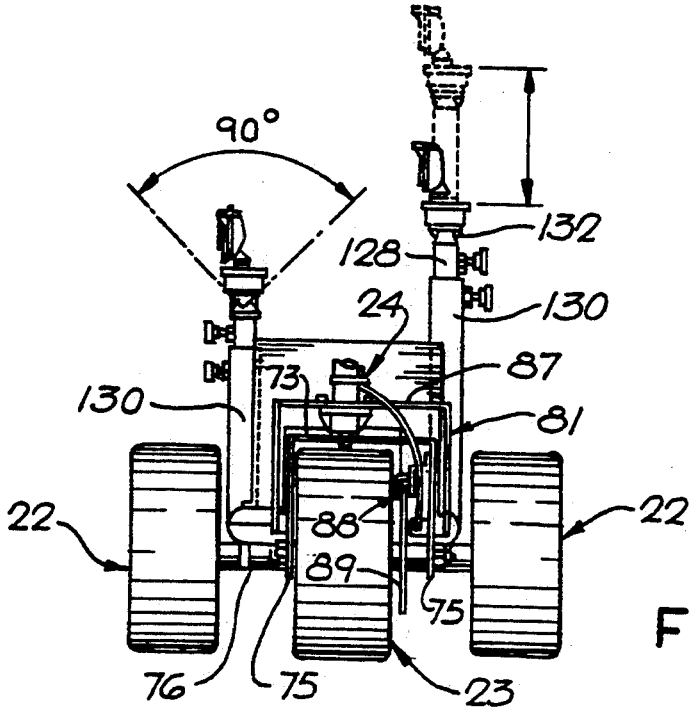
FIG. 3 is a right hand end elevation thereof.
Figure 10:
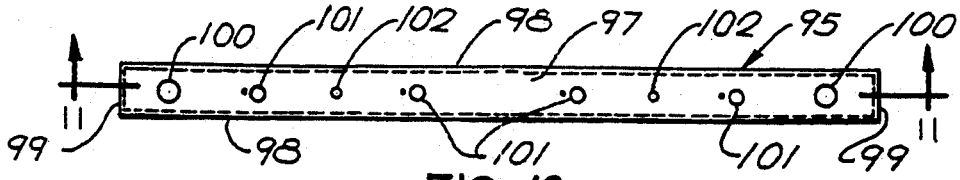
FIG. 10 is top plan view of a light bar cover embodied in the lighting unit of FIG. 1.
Figure 11:
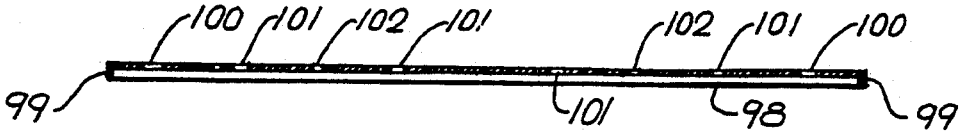
FIG. 11 is a longitudinal cross sectional view of the cover taken substantially along vantage line 11—11 of FIG. 10, looking in the direction of the arrows thereon.

A tubular axle support 64 is mounted transversely beneath the side rails 40, 41 of the main frame and fixed in place by gussets 65 welded to the frame members 40, 41 as shown in FIG. 5 and 29. The tubular axle support 64 receives spindle shafts 66 at its opposite ends which extend outwardly of the frame members 40, 41. The spindle shafts are pressed into the tubular member 64 and appropriately fixed in place by welding or the like to support the two ground engaging wheels 22 on opposite sides of the main frame as illustrated in FIGS. 3 and 4.

With reference of FIGS. 1–4 of the drawings, it will be recognized that the main frame described hereinabove is supported at its forward end by the third front wheel 23 which in conjunction with rear wheels 22 effects a tripod or three point support for the vehicle. To that end, an angulated neck member 70 is fixed at one end to the end frame member 43 to extend forwardly of the main frame and provide an over support for the third wheel 23. The outer end of the neck member 70, remotely of the main frame, has a bearing assembly 71 bolted thereto for reception of a vertical stub axle 72 defining a vertical pivot axis for wheel 23. Such axis is aligned in coplanar relationship with the central longitudinal axis of the vehicle's main frame. The lower end of the stub axle 72 is fixed to an upper cross arm 73 of a wheel supporting yoke, indicated at 74. It will be recognized from FIG. 3 in particular that yoke 74 is an inverted U-shape having depending arm 75, 75 through which a horizontally disposed axle 76 extends so that wheel 23 is mounted between the arms 75 of the yoke. The upper cross arm 73 of the yoke is fixed to the stub axle 72 so that the yoke 74 and wheel 23 are free to pivot about the vertical axis defined by stub axle 72.

To facilitate turning movement of the wheel 23 and its support yoke 74, tow bar 24 comprising a manually engageable handle portion 80 at its outer end is attached to the yoke 74 by a U-shaped towing yoke 81 which is pivotally joined to the two arms 75 of the wheel supporting yoke by bolts 82. In this manner lateral movements of the tow bar produce turning movements of wheel 23 and the application of appropriate pulling force on the tow bar applies corresponding force to the vehicle via the front wheel supporting yoke 74. Thus manual steering manipulation and propulsion of the vehicle may take place. If desired, the tow bar may be coupled to a tow truck or the like for transporting unit 20 long distances. For clandestine operations the tow bar may be eliminated and the wheel 23 equipped with a remotely controlled steering motor powered by a separate battery power source.

It will be recognized from FIG. 1 that in addition to handle 80 at the outer end of the tow bar 24, a brake handle 85 extends from one side of the tow bar adjacent handle 80. This brake handle supports a brake lever 86 adapted to actuate a sheathed wire cable 87 (see FIG. 3) leading to a caliper brake assembly 88 mounted on the inside of the wheel supporting yoke 74 and adapted to cooperate with a brake disc 89 attached to the wheel axle 76 for rotation therewith. The brake assembly 88 and operator 86, typified by the familiar bicycle or motorcycle caliper brake assemblies, operates to brake the vehicle front wheel 23 in response to tensioning of the cable 87 between the operating handle therefor and the brake assembly to engage brake pads with opposite faces of the brake disc 89 in a known manner.

It will be recalled from previous description that the several mounting masts 26, 26*a*, 27 and 27*a* carry across their upper ends a pair of parallel spaced light bars 28 and 29. Inasmuch as the two light bars are identical, a description of one will suffice for both and to that end reference is now made to FIGS. 10–15 wherein the features of light bar 28 are set forth.

Figure 14:
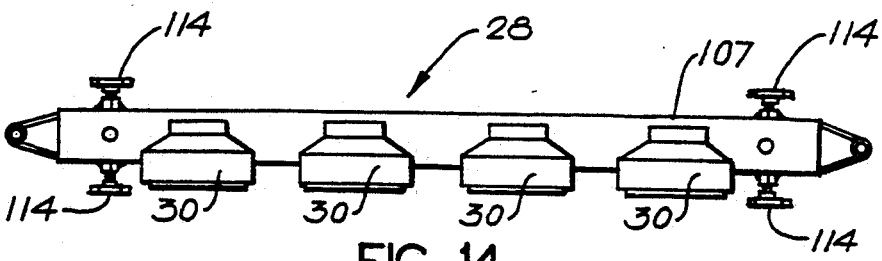
FIG. 14 is a top plan view of an assembled light bar illustrated in FIGS. 1 and 2 of the drawings.

As shown in best in FIG. 14 of the drawings, light bar 28 comprises a shallow rectangular cover 95 adapted to close over the upper side of an elongated rectangular open top box frame 96. Cover 95 as best detailed in FIGS. 10 and 11 comprises an elongated, planar rectangular profiled top wall 97 which forms the top of the assembled light bar and which is bordered by downwardly turned elongated parallel side walls 98, 98 interconnected at their opposite ends by relatively short parallel end walls 99, 99. The top wall 97 is distinguished by a pair of relatively large circular openings 100 adjacent the end walls 99 thereof and four intermediate size openings 101 in which the flood lights 30 are mounted. Two smaller openings 102 are provided substantially one third of the distance from each of the end walls 99 for reception of fastener bolts 103 having cooperating wing nuts 104 for fastening the cover over main frame 96 in assembly (see FIG. 15).

Figure 12:
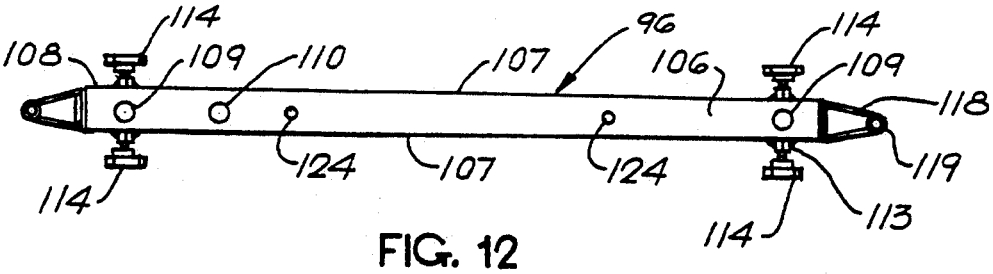
FIG. 12 is a top plan view of the light bar, frame with cover removed.
Figure 13:
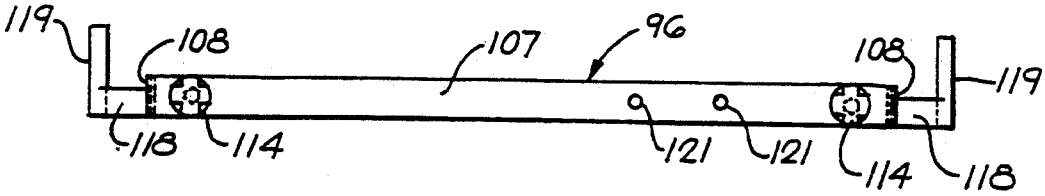
FIG. 13 is a rear elevation of the light bar frame, illustrated in FIG. 12.

The frame 96 as shown best in FIGS. 12 and 13 comprises a planar bottom wall 106 of elongated rectangular configuration, but somewhat shorter and narrower than cover wall 97 and which is bordered at its margins by upstanding parallel side walls 107 and parallel end walls 108 which are joined to walls 107 to form an open top box. The bottom wall 106 is distinguished by two enlarged openings 109 adjacent its opposite ends which are registeringly aligned with openings 100 in cover wall 97. In addition a third large opening 110 is provided for reception of a cable connector 111 for joining a power cable to the light bar. The two side walls 107 each have enlarged openings 112 adjacent opposite ends of the frame which are registeringly aligned and are partly covered by threaded nut members 113 for reception of threaded stud shanks of clamping wheels 114. It will be noted that opposing wheels 114 are disposed adjacent each end of the box frame for purposes which will be apparent presently.

Figure 15:
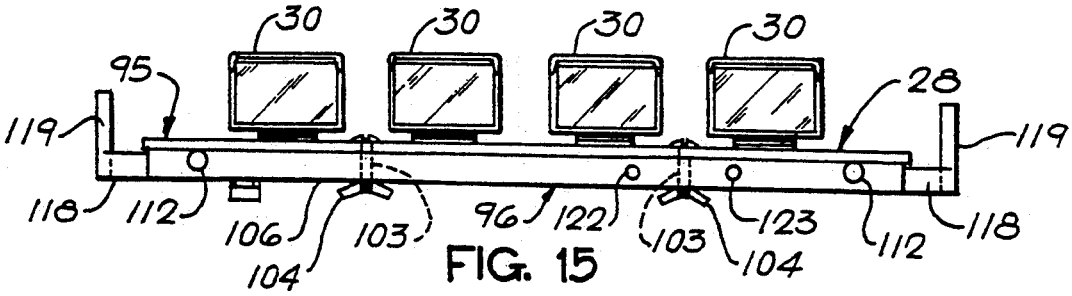
FIG. 15 is a front elevation of the assembled light bar shown in FIG. 14.

The end walls 108 of the frame 96 are each provided with an outwardly extending angle bracket 118 which forms a triangle with the adjacent end wall 108 and is secured at its base to such end wall by welding. The apex of the triangular formation provided by each bracket 118 is distinguished by a cylindrical tubular or solid member 119 secured to the legs of the triangle by welding and which extends vertically upwardly from bracket 118, as illustrated in FIG. 13 of the drawings. One of the side walls 107 of the frame is provided with a pair of openings 121 which are laterally spaced and generally located to one side of the mid-point of the frame for reception of switches 122 and 123 for controlling illumination of the lamps 30. For instance, switch 122 may control illumination of the in board pair of lamps 30 as shown in FIG. 14 while switch 123 may control illumination of the outboard pair of lamps. The bottom wall 106 of the frame 96 is also provided with a pair of openings 124 located symetrically of the mid-point of the frame and in registering alignment with the openings 102 in cover 95 for the passage of the fastening bolts 103 when the cover is assembled over the open upper side of the box frame, as shown in FIG. 15.

With reference now to FIGS. 16–22 of the drawings, the features of the extensible masts, such as mast **26–27*a* shown in FIGS. 1 and 2** of the drawings, will be described.

Figures 16, 17, 18, 19, 20:
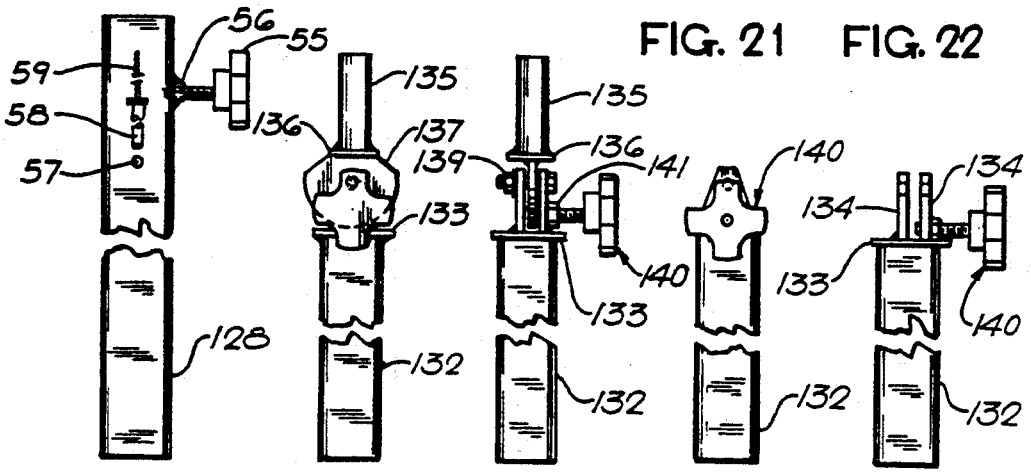
FIG. 16 is a foreshortened front elevational view of an intermediate section for a light bar support mast shown in FIG. 1.
FIG. 17 is a front elevation of a telescopic support mast section and light mounting attachment in assembled relation.
FIG. 18 is a side elevation of the mast section and attachment shown in FIG. 17.
FIG. 19 is a front elevation of the mast section shown in FIG. 17 and 18, divorced from the mounting attachment illustrated in such figures.
FIG. 20 is a side elevation of the mast section shown in FIG. 19.
Figure 25:
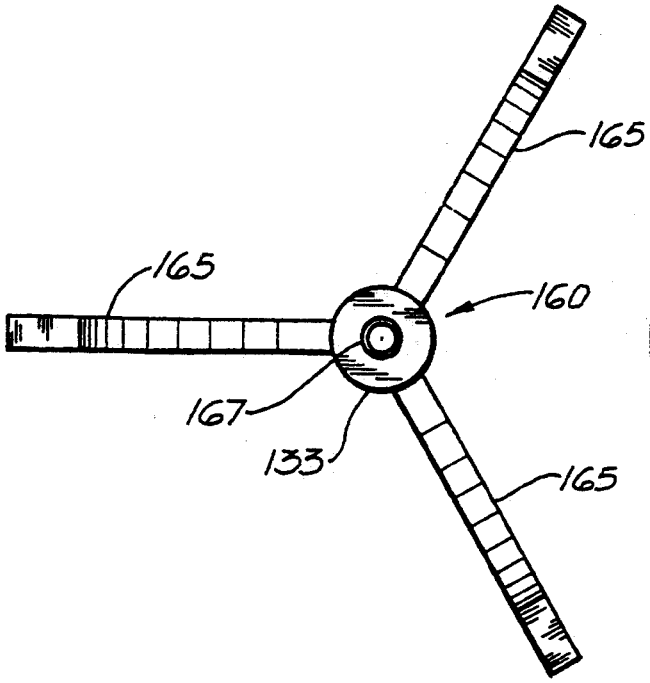
FIG. 25 is a top plan view of a portable light support post for use with the flood lights, shown in FIGS. 23 and 24.
Figure 26:
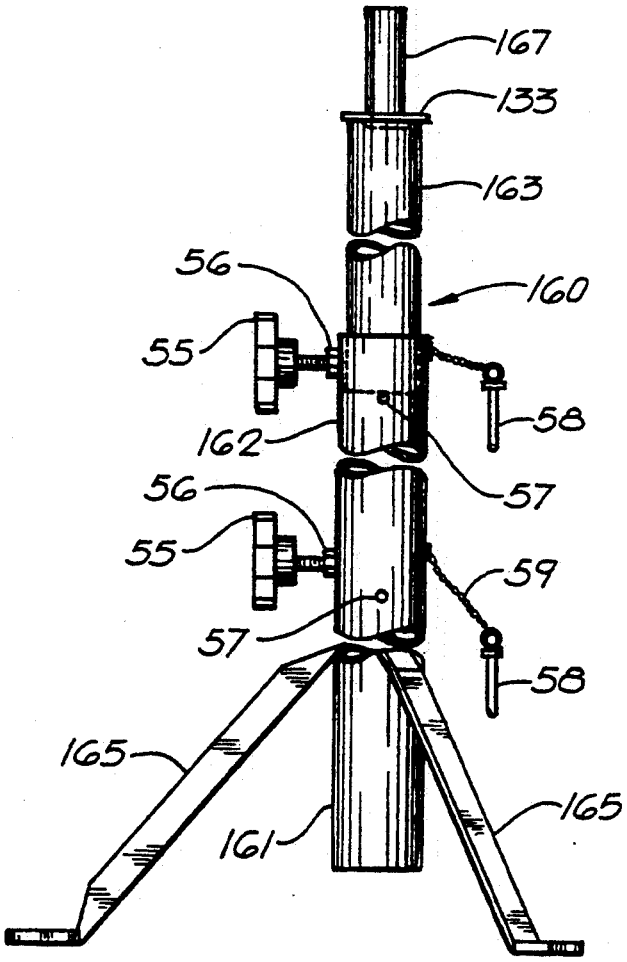
FIG. 26 is a foreshortened front elevational view of the support post shown in FIG. 25.

From FIG. 16 it will be recognized that an intermediate mast section 128 is shown which is adapted to be fitted telescopically into a base section of any one of the masts **26–27*a* shown in FIG. 1 and more particularly in masts 26*a* and 27*a* where three-section telescopic masts are indicated. As shown, intermediate mast section 128 has a locking pin 58 secured by chain 59 near its upper end for cooperation with holes 57 and also is equipped with a thumb wheel locking bolt 55 engagable with threaded nut 56 welded to the outside of the mast section in accordance with corresponding structure previously described. Although the preferred embodiment of the masts 26–27*a* illustrated in FIG. 1** indicate rectangular or square metal tubing, each of the telescopic sections thereof may be circular in cross section if desired without departing from the purpose or functioning of the mast.

In FIG. 17 a top mast section 132 is illustrated which comprises a cap member 133 across the upper end thereof having a pair of upwardly extending parallel spaced arms 134, 134 welded at their bottom ends to the upper face of the cap member (see FIGS. 18 and 20). A mounting post 135 comprising a short section of cylindrical solid or tubular metal having a bottom flange 136 at its lower end is welded to an adjustment sector 137. A generally central opening 138 is provided through the sector 137 for the passage of a pivotal mounting bolt assembly 139 which passes through appropriate openings in the two arms 134, 134 in the central opening 138 of the adjustment sector (see FIGS. 17 and 18). In this fashion the mounting post 135 is pivotal about the bolt assembly 139 through an arc of substantially 180°. In order to secure the mounting posts in the desired position of angularility with respect to the longitudinal axis of the telescopic section 132 and the remainder of an associated mast assembly, a thumb wheel bolt 140 is threadingly received through a nut 141 welded to the outer face of one of the mounting arms 134 in the same manner as employed for the thumb wheel bolts 55, previously described. The inner end of bolt 140 engages sector 137 to lock it in adjusted position.

Figure 2:
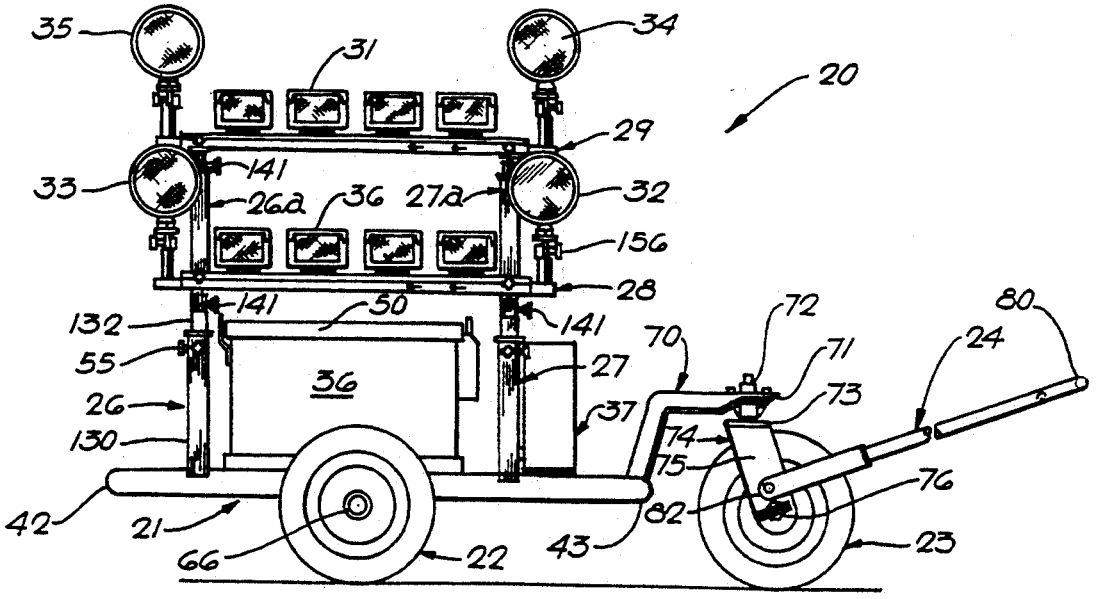
FIG. 2 is a front elevational view of the lighting unit illustrated in FIG. 1.

It will be appreciated from FIGS. 1 and 2 of the drawings that with a base mast section 130 equipped with a top mast section 132, as in the mast assemblies 26 and 27, for example, mounting posts 135 are positioned to project through the enlarged openings 109 adjacent opposite ends of the light bar 96 to mount and accurately locate the light bars across the upper ends of the two masts 26 and 27. The light bar 96 may be locked in positions by operation of the thumb wheel or clamping bolts 114 associated therewith. In a similar fashion the light bar 29 is mounted across and fastened to the upper ends of the masts **26*a* and 27*a***.

Desired tilting movement of the two light bars to appropriate angular positions about the central axes of the sector members 137 as previously noted is effected by manipulation by the thumb wheel bolt 140; loosening the thumb bolts to permit arcuate movement of the associated lamp bar after which the thumb bolts are retightened against the sector members 137 to fix the light bars in a desired angular position for accordingly training the lights.

Figure 23:
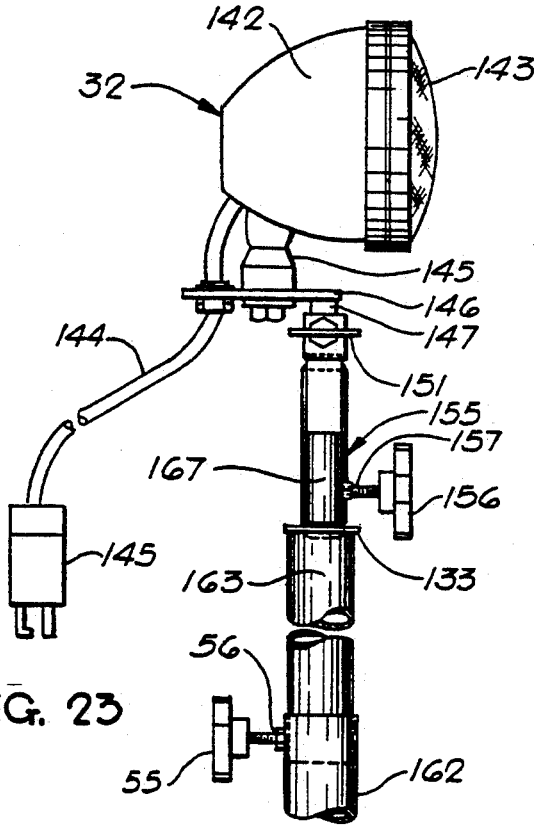
FIG. 23 is a foreshortened side elevational view of the upper end of a portable light supporting mast and a removeable flood light mounted thereon.
Figure 24:
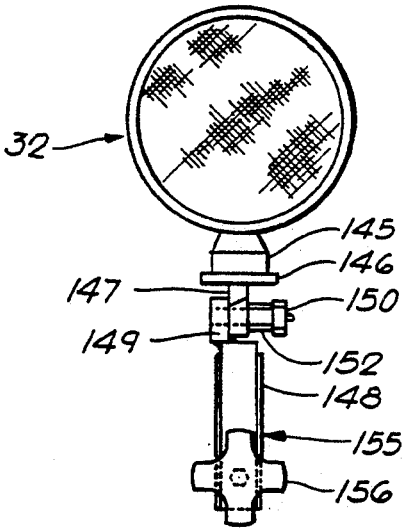
FIG. 24 is a front elevational view of the flood light shown in FIG. 23, divorced from the mast assembly shown in that figure.
Figure 21:
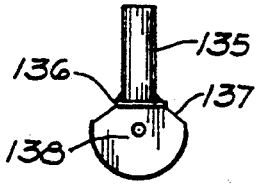
FIG. 21 is a front elevation of the light mounting attachment shown in FIGS. 17 and 18.
Figure 22:
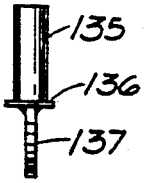
FIG. 22 is a side elevation of the attachment shown in FIG. 21.

With reference now to FIGS. 23 and 24, the particulars of the portable flood lights, such as light 33, therein illustrated, will be set forth. As shown the flood light assembly 32 comprises a commercially available spotlight such as used on trucks and off road vehicles having a housing 142 equipped with a magnifying lens 143 at one end and conventionally mounting a 12 volt high intensity halogen light bulb within the apex of a parabolic reflector behind lens 143. Energization of the light bulb is effected over a two conductor cable 144 having a suitable male connector 145 at its outer end for connection to the power control console 37, as will appear presently.

Housing 142 is equipped with a swivel mount 146 fastened to a planar support plate 146 which in turn carries a depending mounting ear 147 adjacent the forward end thereof for connection with a cylindrical male mounting post 148 having a connective ear 149 at its upper end. A clamp bolt 150 having a manually engageable handle portion 151 passes through a cylindrical spacer 152 and through a central opening formed in the mounting ear 147 for threaded connection with an appropriately threaded opening in the ear 149 extending upwardly from mounting post 148. This arrangement permits pivotal or tilting adjustment of the flood light with respect to the mounting post 148 by loosening the bolt 150, moving the light about the axis of such bolt to an appropriate angle of alignment or train and retightening bolt 150 to maintain the flood light in a desired illuminating position.

The post 148 is secured within the upper end of a tubular mounting sleeve 155 (see FIG. 23) equipped with a thumb wheel clamping bolt 156 which threads through a threaded nut 157 welded at the outside of the mounting tube 155 as in the previously described arrangement of the thumb wheel locking bolt 55 associated with the telescopic mast 26–27*a*. The tubular interior of the mounting tube 155 is adapted to mount over the upstanding posts 119 extending upwardly from opposite ends of the two light bars 28 and 29 whereby to secure the flood lights 32–34 in their mounted position on the light bars as illustrated in FIGS. 1 and 2 of the drawings. Importantly the post 148 and its attached mounting tube 155 form a handle means whereby the operator of unit 20 may remove a flood light from its light bar and carry it about or mount it on a remote mounting post, as will appear presently.

Alternatively, inasmuch as the flood lights 32–34 are intended to be portable and divorced from vehicle 20 upon occasion, a telescopic ground supported support post assembly 160 as illustrated in FIGS. 23–26 as contemplated. Such portable support post is made substantially identical to the telescopic mast structures heretofore described with the exception that in the particular embodiment illustrated, post 160 is made up of cylindrical tubular sections such as a base section 161, an intermediate section 162 and a top section 163 (see also FIG. 27). It will be recognized that the bottom tubular section 161 is fitted with three radially angularly downwardly extending, ground engaging legs 165 disposed at 120° intervals about the circumference of the support post to provide a tripod support therefor. In addition, each of the bottom sections 161 is equipped with the thumb wheel adjustment bolt 55 which threads through a nut 56 welded to the post section 161 as well as a locking pin 58 anchored to the post section 161 by chain 59 and adapted to enter a hole 57 through the walls of the post section 161 for locating the intermediate section at a predetermined elevation or extended position with respect to the base or bottom section 161. In a similar fashion the intermediate section 162 is equipped with the thumb wheel locking bolt 55 and pin 58 for cooperation with the top section 163.

A planar flange cap 133 is mounted across the upper end of the top section to which is secured a cylindrical mounting pin 167 corresponding to the pin 135 associated with the mast structure illustrated in FIGS. 17 and 18, for example. Pin 167 is adapted to be received within the mounting sleeve 155 of an associated spotlight 32–34 and secured in position by tightening the clamping bolt 156, as previously noted.

Figure 27:
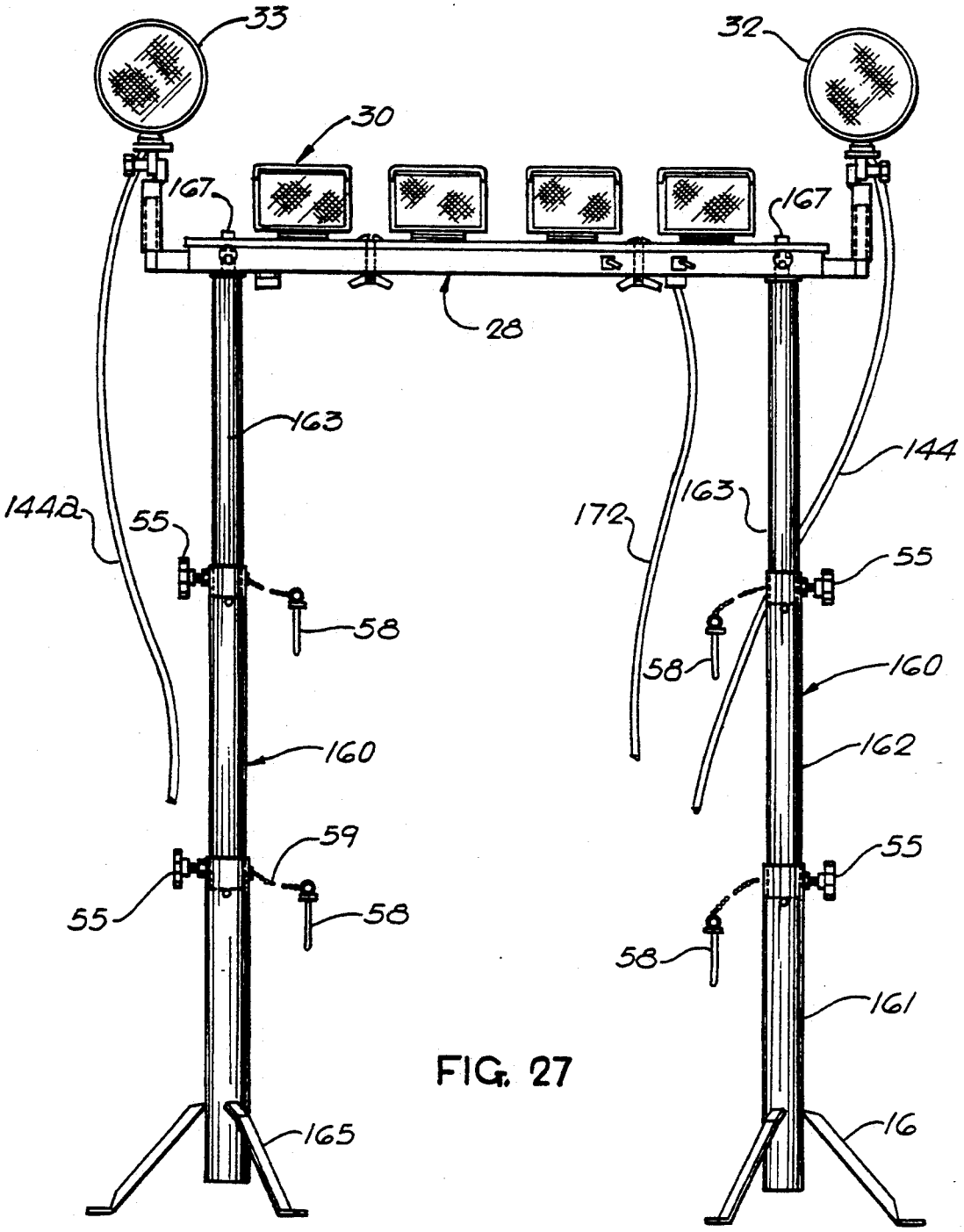
FIG. 27 is a front elevational view of two portable support posts and lamp bar assembly for locating a lamp bar and accompanying flood lamps remotely of the vehicle illustrated in FIG. 1.

In FIG. 27 two portable post assemblies 160 are illustrated for mounting one of the light bars (such as bar 28) therebetween, remotely of vehicle 20.

Figure 28:
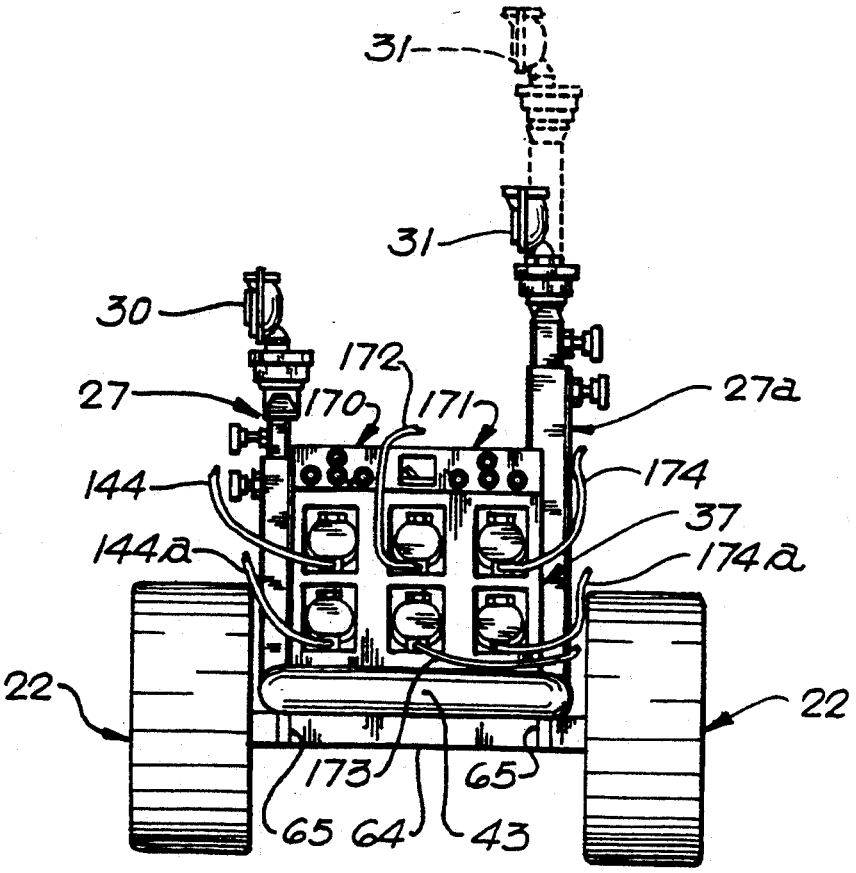
FIG. 28 is a right hand end elevational view of the lighting unit shown in FIGS. 1 and 2 of the drawings with the front wheel and tow bar removed therefrom.

It will be recalled that the several lights and lamps associated with the vehicle 20 are powered over the control console 37 and to that end reference is now made to FIG. 28 of the drawings. As there shown, the console 37 has a distribution panel equipped with six switches arranged in two banks indicated generally at 170 and 171; bank 170 comprising a master power control switch, a light bar control switch and individual control switches for the two spotlights 32 and 33 associated with light bar 28. In similar fashion the switch bank 171 comprises master control switch, a light bar control switch and individual spotlight control switches. The console also presents six weather covered female connector outlights or sockets, each receptive of a male connector fitting such as 145 indicated in FIG. 23 of the drawings. Individual cables lead from two of the six outlets to each of the light bars 28 and 29 as indicated at 172 and 173, respectively. Conductor 144 leads to the spotlight 32 and 144*a* which leads to spotlight 33. In similar fashion, spotlights 34 and 35 are serviced over cable conductors 174 and 174*a*.

Console 37 also contains appropriate circuit breakers (not shown) in circuit connection with the battery in compartment 36 via conduit carried cables (not shown herein), but connected with the control console 37 at fitting 180, as illustrated in FIG. 1 of the drawings. The circuit breakers are arranged to guard the battery against shorts occurring in any of the individual flood lights or light bars. Also as heretofore noted, each of the light bars is equipped with control switches 122 and 123 for controlling selective illumination of the lamps mounted thereon, such as the lamps 30 and 31 (see FIGS. 1 and 2).

As previously related the lamps 30, 31 and the flood lights 32–34 are preferably high intensity light such as halogen lights capable of producing total candle power output in the range of 1–3 million candle powers. The power source preferably comprises high capacity, wet cell, single or multiple batteries protectively carried within the battery compartment and having a useful single charge life of 6–12 hours for sustained light illumination by vehicle 20.

It is fully contemplated that relatively simple modifications of the herein described preferred embodiment of this invention may be carried out with normal skill. For example, the herein described vehicle may be modified for clandestine uses to a battery powered, self propelled vehicle having remote controlled motorized steering so that it may be placed in a desired location without exposing operating personnel. Motion detectors could also be employed to energize the lights, making the same highly effective for border patrol operations and the like.

Thus it is believed that those familiar with the art will readily recognize the novel advancement of the present invention over the prior art and will readily appreciate that while the same has herein been described in association with a particular preferred embodiment illustrated in the accompanying drawings, the same is susceptible to variations, modifications and substitution of equivalents without departing from the spirit and scope of the invention which is intended to be unlimited by the foregoing except as appears in the following appended claims.

The embodiments of the invention in which an exclusive property or privilege is claimed are defined as follows:

1. An all terrain, portable lighting unit comprising:

a substantially rectangular, lightweight rigid frame;

plural ground engaging wheels undersupporting said said frame; two of said wheels being coaxially mounted outboard of the longitudinal sides of said frame on a horizontal axle positioned substantially midway between opposite ends of said frame and at least a third one of said wheels being mounted forwardly of an operationally leading end of said frame for pivotal steering movements about a vertical axis;

a heavy duty battery carried in a protective enclosure mounted on said frame over said axle;

multiple pairs of mutually parallel, telescopically adjustable, multipart vertical masts fixed to said frame;

plural horizontal light bars detachably secured to and extending across the upper ends of the members of each pair of said masts for independent pivotal movement about laterally separated horizontal axes paralleling the longitudinal sides of said frame;

a plurality of high intensity electric flood lamps mounted on said bars to project upwardly therefrom for selective pivotal movement therewith about said axes;

said lamps projecting upwardly from said bars and being adjustably moveable therewith; and means for electrically coupling said lamps to said battery for selective energization thereby.

2. An all terrain, manually portable lighting unit comprising:

a generally rectangular, lightweight metal frame, a horizontal axle attached to said frame in normal alignment to the frame's longitudinal axis substantially midway between the opposite ends thereof;

a pair of ground engaging wheels rotatably mounted on opposite ends of said axle laterally outwardly of the elongated sides of said frame;

a third wheel rotatably mounted in a steering yoke mounted forwardly of one leading end of said frame for steering movements about a vertical axis, elongated pulling means pivotally attached to and extending from said yoke for imparting positive manually steering movements to said third wheel and for transmitting pulling force to said frame;

a heavy duty battery mounted on said frame over said axle;

two pairs of mutually parallel, telescopically extensible, vertically adjustable, multi-part masts fixed to said frame, one pair adjacent each said elongated side thereof;

a pair of parallel spaced, horizontal light bars, one pivotally attached to and extending between the upper ends of the members of each pair of said masts so as to be disposed in elevated positions over said frame and in spaced parallelism with the elongated sides thereof; said bars being adjustably moveable about parallel pivot axes;

a plurality of high intensity flood lamps mounted on said bars to project upwardly therefrom and move therewith about said axes; and connective means for electrically coupling said lamps to said battery for selective energization thereby.

3. The combination of claim 2, wherein said connective means comprises a distribution panel having circuit connection with said battery, electrical conductors extending between said panel and each of said light bars and lamps, and switch means for selectively controlling individual energization of said lamps.

4. The combination of claim 2, and at least one portable spotlight detachably mounted on at least one of said bars and coupled to said connective means for selective energization.

5. The combination of claim 2, and a plurality of portable spotlights supported on each of said bars and each coupled to said connective means for selective energization.

6. The combination of claim 5, and means for locking said spotlights in selected positions of adjustment.

7. The combination of claim 6, and manually engageable handle means associated with each of said spotlights comprising a male member receptive in a female member to effect detachable supporting connection between each spotlight and its associated said light bar; the locking means operating to adjustably interlock the male and female members.

8. The combination of claim 2, wherein said telescopic masts include means operable to selectively adjust the elevation of each said light bar independently of the other.

9. The combination of claim 3, wherein said frame is fabricated from lightweight tubular members comprising coplanar parallel linear side rails joined at their ends by coplanar end rails, and means for supporting said battery and distribution panel on said frame.

10. The combination of claim 6, wherein each of said spotlights is coupled to said connective means by a power cable of sufficient length to permit positioning each spotlight remotely of said light bars, and portable posts for supporting said spotlights at locations remotely of said light bars.

11. The combination of claim 2, and pivotal connectors defining a horizontal pivot axis joining each light bar to its one pair of said masts whereby each light bar is independently tiltable about its said horizontal pivot axis to adjustably position the illumination field of said lamps thereon.

* * * * *